US010024594B2

(12) United States Patent
Staedel et al.

(10) Patent No.: US 10,024,594 B2
(45) Date of Patent: Jul. 17, 2018

(54) DOMESTIC REFRIGERATION APPLIANCE HAVING AN INTERIOR LIGHTING APPARATUS AND TRANSPARENT COMPARTMENT DIVIDERS

(71) Applicant: BSH HAUSGERAETE GMBH, Munich (DE)

(72) Inventors: Stefan August Staedel, Munich (DE); Sebastian Knoell, Hamburg (DE); Uwe Beimborn, Altena (DE); Andreas Schulte, Luedenscheid (DE)

(73) Assignee: BSH Hausgeraete GmbH, Munich (DE)

( * ) Notice: Subject to any disclaimer, the term of this patent is extended or adjusted under 35 U.S.C. 154(b) by 149 days.

(21) Appl. No.: 14/897,248

(22) PCT Filed: Jun. 10, 2014

(86) PCT No.: PCT/EP2014/061993
§ 371 (c)(1),
(2) Date: Feb. 16, 2016

(87) PCT Pub. No.: WO2014/198704
PCT Pub. Date: Dec. 18, 2014

(65) Prior Publication Data

US 2016/0153706 A1 Jun. 2, 2016

(30) Foreign Application Priority Data

Jun. 11, 2013 (DE) ..... 10 2013 210 893

(51) Int. Cl.
*A47B 96/04* (2006.01)
*F25D 27/00* (2006.01)
(Continued)

(52) U.S. Cl.
CPC ..... *F25D 27/00* (2013.01); *F25D 23/00* (2013.01); *F25D 23/02* (2013.01); *F25D 23/062* (2013.01);
(Continued)

(58) Field of Classification Search
CPC ..... A47B 67/005
(Continued)

(56) References Cited

U.S. PATENT DOCUMENTS 5,735,589 A * 4/1998 Herrmann ..... B29C 33/123 108/102
8,021,009 B2 9/2011 Knoell et al.
(Continued)

FOREIGN PATENT DOCUMENTS

DE 102005057154 A1 5/2007
DE 202007002350 U1 5/2008
(Continued)

*Primary Examiner* — Matthew W Ing
(74) *Attorney, Agent, or Firm* — Laurence A. Greenberg; Werner H. Stemer; Ralph E. Locher

(57) ABSTRACT

A domestic refrigeration appliance includes an interior for receiving foodstuffs which is bounded by walls, a door for closing the interior, a lighting apparatus which is configured to illuminate the interior at least while the door is open and at least one plate-shaped compartment divider which is disposed in the interior and is made of a transparent material. The lighting apparatus has a plurality of light sources which are disposed in a top wall bounding the interior and are oriented in such a way that the interior has substantially uniform illumination above and below the compartment divider because of the emitted light of the light sources.

21 Claims, 5 Drawing Sheets

(51) Int. Cl.
*F25D 23/00* (2006.01)
*F25D 23/02* (2006.01)
*F25D 23/06* (2006.01)

(52) U.S. Cl.
CPC ..... *F25D 23/069* (2013.01); *F25D 2327/001* (2013.01)

(58) Field of Classification Search
USPC ..... 312/401, 408, 223.5; 62/264
See application file for complete search history.

(56) References Cited

U.S. PATENT DOCUMENTS

| | | | | |
|---|---|---|---|---|
| 8,556,440 | B2 * | 10/2013 | Hong | F25D 27/005 362/94 |
| 8,938,984 | B2 * | 1/2015 | Probst | F25D 29/005 62/264 |
| 2008/0012459 | A1 * | 1/2008 | Picken | F24C 15/16 312/408 |
| 2008/0030114 | A1 * | 2/2008 | Becke | A47B 57/425 312/408 |
| 2009/0084914 | A1 * | 4/2009 | Picken | F25D 23/067 248/206.5 |

FOREIGN PATENT DOCUMENTS

| | | | |
|---|---|---|---|
| JP | 05256568 | * | 10/1993 |
| JP | 2000258051 | A | 9/2000 |
| JP | 2007032861 | A | 2/2007 |

* cited by examiner

DOMESTIC REFRIGERATION APPLIANCE HAVING AN INTERIOR LIGHTING APPARATUS AND TRANSPARENT COMPARTMENT DIVIDERS

BACKGROUND OF THE INVENTION

Field of the Invention

The invention relates to a domestic refrigeration appliance having an interior for accommodating foodstuffs, which is bounded by walls. The domestic refrigeration appliance also has a door for closing the interior and further comprises a lighting apparatus which is configured to illuminate the interior at least while the door is open. The domestic refrigeration appliance also comprises at least one plate-type compartment divider which is arranged in the interior and is made of a light-permeable material.

Domestic refrigeration appliances that offer illumination of the interior while the door is open are widely known. Such illumination is standard but when there is a large quantity of foodstuffs present has the disadvantage, due to the positioning of the light sources, that the viewing scenario and therefore user-friendly identification of the foodstuffs in the domestic refrigeration appliance or in the interior is limited while the door is open.

Brief Summary of the Invention

It is the object of the present invention to create a domestic refrigeration appliance with which the interior offers a user an improved viewing scenario for identifying the foodstuffs stored therein while the door is open.

This object is achieved by a domestic refrigeration appliance having an interior for accommodating foodstuffs, walls bounding the interior, a door for closing the interior, a lighting apparatus configured to illuminate the interior at least while the door is open and at least one plate-shaped compartment divider disposed in the interior.

The invention relates to a domestic refrigeration appliance having an interior for accommodating foodstuffs, which is bounded by walls. The domestic refrigeration appliance also comprises a door for closing the interior and a lighting apparatus which is configured to illuminate the interior at least while the door is open. The domestic refrigeration appliance further comprises at least one plate-type compartment divider which is arranged in the interior and is made at least partially of a light-permeable material. The compartment divider divides the volume of the interior into sub-volumes. It is therefore arranged in particular so that when viewed in the vertical direction of the domestic refrigeration appliance one sub-volume of the interior is configured above the compartment divider and at least one further sub-volume of the interior is configured below the compartment divider. One important concept of the invention is that the lighting apparatus has a plurality of light sources which are arranged in a top wall bounding the interior and are oriented in such a manner that the interior has substantially uniform illumination above and below the compartment divider due to the emitted light.

The light sources arranged in the top wall therefore allow light to be distributed in the interior in such a manner that the sub-volumes of the interior formed by the compartment divider are also illuminated in a substantially uniform manner and are not just lit in an arbitrary fashion. The lighting apparatus is therefore arranged and designed such that the light emitted from the light sources and therefore only radiated downward into the interior is distributed and guided in such a manner that the sub-volumes of the interior that are configured one above the other when viewed in a vertical direction are also illuminated in a substantially uniform manner.

A substantially uniform illumination is understood in particular to be illumination with which, when viewed from the front by a user, a visually very uniform light volume appears, in which there are no major brightness differences, in particular no local brightness fluctuations that would dominate and draw the attention of a user.

Such an embodiment allows a much more user-friendly and clear view of the interior and the foodstuffs therein while the door is open. Even if the interior is very full it allows a user to view and identify the objects in the interior much more easily.

In one advantageous embodiment first light sources of the lighting apparatus are arranged in such a manner that their emitted light strikes a light injection region configured in the rear region of the compartment divider which is configured as a light guide and can be guided to a light output region in the compartment divider. Such a configuration means that a compartment divider, the functionality of which is designed to separate and configure sub-volumes of the interior and which represents a base for the positioning of foodstuffs at least for a sub-volume configured above it, is used for the further functionality of light guidance. The multi-functionality of said compartment divider specifically in respect of its optical use therefore allows very specific and desirable light guidance to specific points of the interior, thereby improving illumination in this context.

It is particularly advantageous if the plate-type compartment divider, which generally extends over the width of the interior and is therefore horizontally oriented, presents itself as a whole as a light guide. Such a configuration allows the injected light to be guided in a very uniform manner over the entire width in the light guide and to be output again at specific desired points, thereby achieving a very uniform light distribution and illumination in specific sub-volumes of the interior. Because the compartment divider is embodied with a relatively large surface, a light guide with a relatively large surface is also formed so that a large quantity of light can be injected and a large quantity of light can be output at preferably correspondingly large light output regions. This favors highly defined and homogeneous light emission, thereby achieving very uniform and extensive illumination of the interior.

Provision is preferably made for the light injection region to be formed by at least part of a rear edge, in particular by the entire rear edge and therefore over the entire length of the rear edge, of the compartment divider. Such a configuration is particularly advantageous as it means that even a compartment divider holding a number of food items for example allows adequate and extensive illumination of sub-volumes, as the light from the light sources does not first have to be radiated directly forward in an extensive and complicated manner over the foodstuffs but can be used for largely unrestricted light guidance in a rear region of the interior, which is generally very close to the rear wall and generally not covered with foodstuffs, and injection into the light guide in the form of the compartment divider is in practice not undesirably impaired. It means that as a result of the virtually horizontal light guidance forward to the light output region in the compartment divider the light can be transported to points where extensive radiation and preferred illumination are again achieved in the lateral and/or front region of the interior.

Provision is made in particular for a surface of said part of the rear edge or the surface of the entire rear edge to be configured at an angle other than 90° to an upper face and/or a lower face of the compartment divider. Such an angling of said rear edge produces a particularly advantageous light injection region which allows extensive light injection so a particularly large quantity of light enters the compartment divider and can be radiated out again at the light output region so improved illumination by the lighting apparatus is achieved here too.

As a result of such angling of the rear edge being formed, optical surfaces are formed which allow better injection and, depending on orientation, also allow a high reflection coefficient of light already injected into the compartment divider in the desired direction toward the light output region. This angled orientation of the rear edge can thus be oriented obliquely downward and to the rear from the upper face as well as in the counter direction and thus obliquely downward and forward from the upper face.

Said surface of said part of the rear edge or the surface of the entire edge, which is configured at an angle other than 90° to an upper face and/or a lower face of the compartment divider, is preferably configured as a flat surface. As a result in a longitudinal section or vertical section through the compartment divider said compartment divider is configured as wedge-shaped or as pointed or tapering to the rear in the rear region. Two straight lines meet in this sectional view, the surface and the lower face or the surface and the upper face, at an angle smaller than 90°. This embodiment as a flat surface allows appropriate maximizing light injection for each situation as a function of the angle.

It is particularly preferable for said surface of said part of the rear edge or the surface of the entire rear edge, which is configured at an angle other than 90° to an upper face and/or a lower face of the compartment divider, to be configured as a curved surface. Said surface is preferably curved in a convex manner at least in parts, in particular being curved in a convex manner, in particular being curved in a uniformly convex manner, over its entire extension between an upper face and a lower face of the compartment divider. As a result in a longitudinal section or vertical section through the compartment divider said compartment divider is configured with a bulge, in particular a C-shaped bulge, in the rear region. This embodiment is simple to configure and can be manufactured precisely so reflection can be minimized and light injection maximized. Uniform illumination of the interior is thus achieved to a particular degree.

The light injection region is preferably arranged at a distance from an inner face of a rear wall bounding the interior. On the one hand this assists the circulation of the cool air prevailing in the interior, also allowing the best possible, uniform temperature distribution to be established. On the other hand it assists optical light guidance as a further passage of light and light radiation are also possible through this gap between the rear edge of the compartment divider and the inner face of the rear wall, being able then to pass at least into the sub-volume below said compartment divider for the purpose of illumination.

Provision is preferably made for the light output region of the compartment divider to be formed by a front edge and/or a side edge of the compartment divider. This allows well-defined specific light output points to be formed, which improve illumination and make it more uniform in respect of the geometry and shape of the compartment divider and also the interior. Such points of the compartment divider, with their exposed positions, which are formed as light output regions, then also virtually allow an optical light band to be generated. This allows a user to identify the separation in the interior immediately, specifically with compartments dividers made of a light-permeable material such as glass or plastic, and also allows corresponding light radiation into the interior, which in combination with the other light input into the interior by the lighting apparatus favors the uniform illumination of the entire interior.

Provision is preferably made for the first light sources to be arranged on the top wall in a rear quarter when viewed in the depthwise direction of the domestic refrigeration appliance. These first light sources are therefore positioned relatively far back inside the interior. This results in very short light paths to a light injection region of the compartment divider. Light deflection, which can in some instances be complex, in order to be able to radiate light from the first light source to said light injection regions, are therefore not required. This reduces the number of components and the very direct light path between the first light sources and the light injection region also means that the largest possible light component can be injected.

Provision is preferably made for the first light sources to be arranged in such a manner that their main radiation directions are arranged obliquely forward, in particular at an angle between 5° and 30°, in relation to a vertical rear wall bounding the interior. This configuration assists the illumination of the interior and prevents a relatively large component of the emitted light first being radiated onto the rear wall. This avoids unwanted local scatter and/or reflection regions with a very high scatter and/or reflection intensity on the rear wall. Unwanted points on the rear wall, which have a relatively large surface and very high scatter and/or reflection intensity compared with other regions, can thus be avoided. This advantageously assists the uniform illumination of the interior.

Provision is preferably made for at least two compartment dividers, which are made of a light-permeable material in parts at least, to be arranged at different heights in the interior and each to be configured at least partially with a light injection region at the rear edges. In the case of larger interiors with a number of compartment dividers to configure a number of sub-volumes the lighting apparatus is developed in such a manner with the lighting concept that substantially uniform illumination of the entire interior is achieved here too.

The compartment dividers are preferably oriented horizontally and arranged parallel to one another.

Provision can preferably be made for the compartment dividers to be arranged with their rear edges, which therefore face the rear wall, all at the same distance from said rear wall.

Provision can also be made for compartment dividers, below which a free space is configured, which can be accessed freely from the front, to be arranged with their rear edges at the same distance from the rear wall. Provision can also be made for at least one further compartment divider, which when viewed in a vertical direction is arranged below said compartment dividers at the same distance from the rear wall and below which a pull-out box that is closed at the front is arranged immediately adjoining it—compartment dividers therefore serving as lids for the pull-out box in practice—to be arranged with its rear edge at a shorter distance from the rear wall than the other upper compartment dividers. This allows uniform illumination of the interior to be achieved even when the interior is fitted differently with compartment dividers, which vary in size and/or where a pull-out box is present below the lower compartment divider at the shorter distance. Injection of the light into all the injection regions provided is then achieved.

In particular the rear edge of the higher compartment divider is arranged at a first distance from an inner face of a rear wall bounding the interior. A rear edge of the lower compartment divider is arranged at a second distance from the inner face of the rear wall that is shorter than the first distance. When viewed in a depthwise direction this offset allows light radiated onto the compartment dividers from above to be injected into both light injection regions of the compartment dividers, as some of the emitted light passes by way of the light injection region of the upper compartment divider into said upper compartment divider, with a further component of the emitted light from the first light sources being radiated further downward between the compartment divider and the inner face and being able to be injected into the second compartment divider there as a result of the specific positioning with the difference distances. This also makes a favorable contribution to the substantially uniform illumination of the sub-volumes formed by the compartment dividers.

The lighting apparatus preferably comprises at least two second light sources which are arranged in a front quarter when viewed in the depthwise direction of the top wall. These second light sources are therefore arranged relatively far to the front and close to a loading opening for the interior. The illumination scenario for user-friendly identification of the foodstuffs in the interior is also influenced positively again by this.

Provision is preferably made for the dimensions of the second light sources to extend forward over the front edge of the at least one compartment divider at least in parts when viewed in a depthwise direction. This configuration is particularly advantageous as it allows a certain quantity of emitted light from the second light sources also to pass downward past the upper compartment divider(s), assisting the uniform illumination of all sub-volumes here too, as such positioning of the second light sources with a virtually forward offset at least in parts prevents all or almost all the light component of the second light sources being radiated into the uppermost sub-volume, thereby in some instances additionally illuminating the upper sub-volume relatively significantly with the sub-volumes below receiving relatively little illumination in comparison.

Provision is preferably made for the second light sources to be arranged in such a manner that their main radiation directions are arranged obliquely forward, in particular at an angle between 5° and 30°, in relation to a vertical rear wall bounding the interior. This configuration has the significant advantage that a region in front of the compartment dividers is also illuminated in a specific and defined manner with a desired quantity of light so that when the user observes the interior while the door is open, a brighter appearance is achieved and conveyed. The specific orientation means that this is also achieved virtually over the entire configuration of the sub-volumes when viewed from the front.

Provision is made in particular for the domestic refrigeration appliance to have at least one pull-out box arranged below the at least one compartment divider, being able to be pulled out and moved back in again in a horizontal direction and also being able to be filled with foodstuffs. With such a configuration the second light sources are preferably arranged in such a manner that their main radiation directions are oriented into the inside of the pull-out box when the pull-out box is fully open. This, in particular in conjunction with the orientation at an angle between 5° and 30° in relation to the vertical rear wall, produces a particularly advantageous embodiment for uniform illumination of the inside of the pull-out box when it is open. These second light sources with their specific orientation therefore make it possible not only to contribute advantageously to the uniform illumination of the sub-volumes formed by the compartment dividers but also to allow very comprehensive and for the viewing user very advantageous extensive illumination of the opened pull-out box in the lower region of the interior.

Provision is preferably made for the top wall to be configured with at least two downward steps when viewed in a depthwise direction. Such stepping allows components of a refrigeration circuit of the domestic refrigeration appliance, for example an evaporator, to be arranged outside the interior and therefore also above said top wall in a space-saving and functionally favorable position. Such steps to the rear and downward also mean that access from the front and the filling of the upper sub-volume with foodstuffs are not impaired in an undesirable manner.

Provision is preferably made for the first light sources to be arranged in a rear first step plateau of such stepping of the top wall. With this embodiment the vertical distance between the first light sources and the compartment dividers and therefore the light injection regions is further reduced, allowing the largest possible quantity of light to reach the light injection regions here too.

Provision is also made in particular for the second light sources to be arranged in a front further step plateau that is higher than the first step plateau. It is particularly advantageous if at least this further step plateau is not oriented completely horizontally but has a rearward and downward angled orientation. This configuration favors the illumination contribution of said second light sources. The emitted light component that is to reach the sub-volume is split in the desired manner from the light components to be emitted in front of the compartment dividers and in particular also in the direction of the opened pull-out box, thereby allowing a significant contribution to the uniform illumination of regions to be counted as part of the interior here too.

Provision is preferably made for the lighting apparatus to have at least two first and at least two second light sources which are arranged on the top wall in such a manner that, when looking at the top wall plane and therefore when viewing said top wall plane virtually in a projected manner, connecting lines between two light sources that are respectively adjacent in a peripheral direction form a trapezoidal shape. This means that with such a projected view starting from one light source the light sources connected for example in the clockwise direction form a surface with the connecting lines then present, said surface having a trapezoidal shape. This positional arrangement also advantageously contributes to the desired uniform illumination scenario.

This trapezoidal shape is oriented in particular in such a manner that it is arranged with its shorter base side closer to the rear wall than its longer base side. This means that when the domestic refrigeration appliance is viewed in a widthwise direction the front second light sources are preferably arranged further away from one another than the at least two first light sources.

Provision is preferably made for at least some walls bounding the interior, in particular the top wall, the rear wall and the side walls, to be made of a metallic material, in particular stainless steel, at least on the inner faces facing the interior. These walls can be made of solid metal or have an appropriate metallic coating on their inner faces for example.

The compartment dividers are preferably made of glass or plastic material.

At least one compartment divider can also be arranged so that it can be pulled out of the interior at least partially to present the foodstuffs stored thereon. With this embodiment it is also advantageous if front second light sources are oriented in such a manner as to configure planar lighting from above onto said pulled out compartment divider.

The first light sources and their position as well as the optical interaction with the material of the inner face of the rear wall and/or the material of the side walls mean that optically a floodlight is virtually formed, its light passing down along the inner face of the rear wall, thereby ensuring a specific optical depth effect in respect of the illumination.

The light injection regions of the compartment dividers are in particular polished and chamfered surfaces and/or the light output regions are configured as ground surfaces. Provision is preferably made for the material of the compartment dividers to be such that the injected light passes to the light output regions as a result of total reflection in the compartment divider.

The light sources of the lighting apparatus can preferably be light-emitting diodes. These allow low-energy operation and are also very small so take up little space.

The domestic refrigeration appliance can be a refrigerator or a freezer or a combined refrigerator/freezer. It can also be a wine storage cabinet for example.

In particular a door of the domestic refrigeration appliance can also be configured as transparent at least in parts so that it is possible to look into the interior and see the foodstuffs present therein even while the door is closed. The lighting apparatus is then preferably also configured to illuminate the interior while the door is closed and is therefore also active while the door is closed.

The configuration of the inventive domestic refrigeration appliance or an advantageous embodiment thereof also allows a visually very attractive impression to be conveyed when a user looks into the interior while the door is open, similar to an illuminated display cabinet. The domestic refrigeration appliance therefore presents itself as a high-quality unit.

Further features of the invention will emerge from the claims, figures and description of the figures. The features and feature combinations cited above in the description and the features and feature combinations cited below in the description of the figures and/or illustrated in the figures alone can be used not only in the respectively specified combination but also in other combinations or alone, without departing from the scope of the invention. Details of the invention which are not set out and illustrated specifically in the figures but emerge and can be produced from the details set out by means of separate feature combinations should therefore also be considered to be covered and disclosed by the invention.

BRIEF DESCRIPTION OF THE SEVERAL VIEWS OF THE DRAWING

Exemplary embodiments of the invention are described in more detail in the following with reference to schematic drawings, in which.

DESCRIPTION OF THE INVENTION

Figure 1:
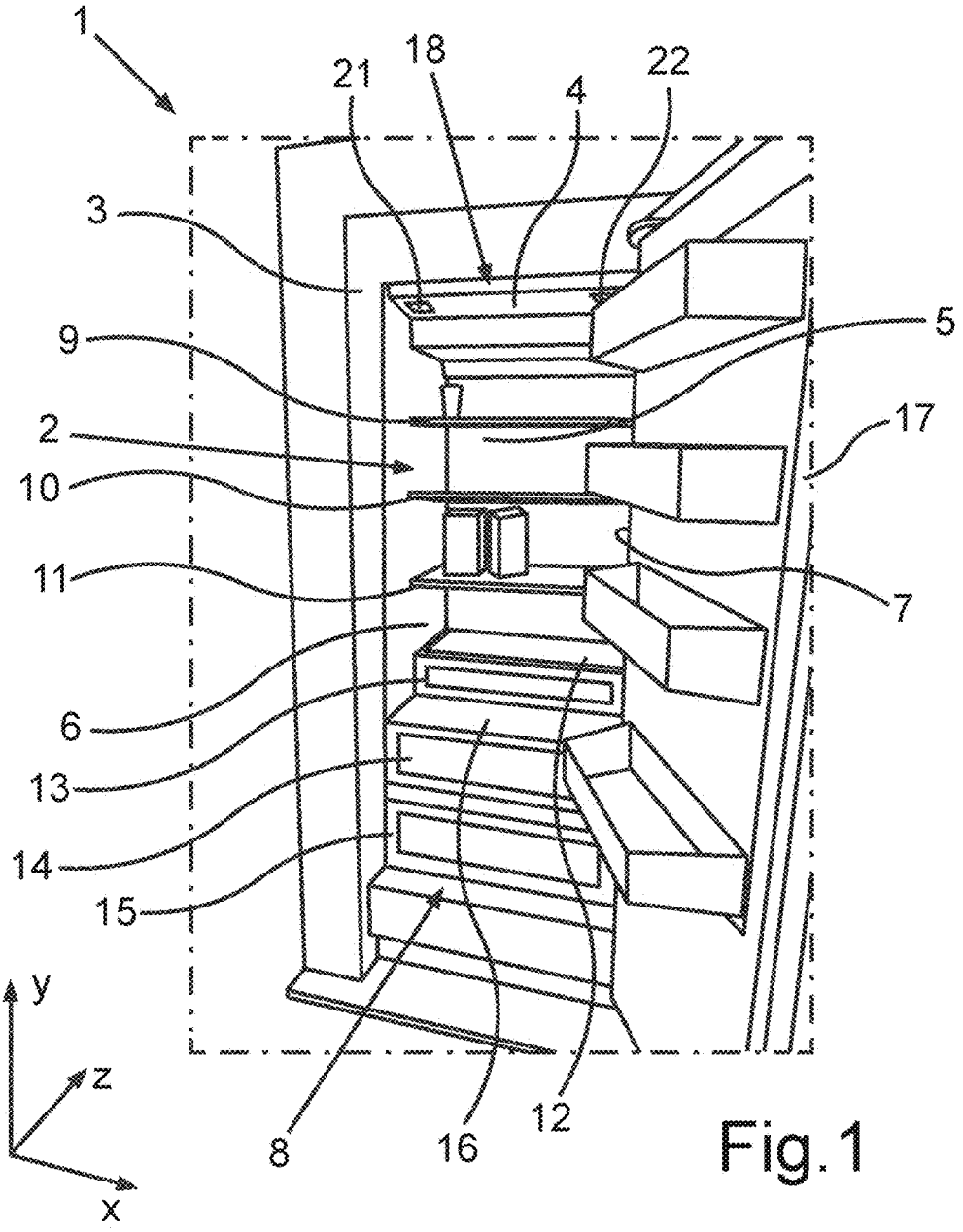
FIG. 1 shows a perspective view of an exemplary embodiment of an inventive domestic refrigeration appliance with the door open.

Identical elements or those of identical function are shown with identical reference characters in the figures.

FIG. 1 shows a schematic diagram of a domestic refrigeration appliance 1, which is configured as a refrigerator, for example a chiller cabinet or a wine storage cabinet.

However the domestic refrigeration appliance 1 can also be configured as a combined refrigerator/freezer for example.

The domestic refrigeration appliance 1 comprises an interior 2, which is configured to accommodate foodstuffs. The interior 2 is bounded by walls of an inner container 3, with a top wall 3, a rear wall 5, side walls 6 and 7 and a base 8 being configured for this purpose.

In the exemplary embodiment provision is made for the top wall 4, the rear wall 5 and the side walls 6 and 7 to be made of a metallic material, in particular stainless steel, on their inner faces facing the interior 2. To this end the walls in question can be formed completely from the metallic material or have an appropriate metallic coating on said inner faces.

In the exemplary embodiment the domestic refrigeration appliance comprises a plurality of compartment dividers 9, 10, 11 and 12, which are configured in the manner of plates and arranged horizontally as well as at a distance from and parallel to one another in the interior 2. These compartment dividers 9 to 12 extend over the entire width (x direction) of the interior 2. They are preferably made completely of a material that allows the passage of light in the spectral range that is visible to humans, for example plastic or glass.

These plate-type compartment dividers 9 to 12 preferably have securing elements, which fasten them to the rear wall 4 for example.

The compartment dividers 9 to 12 form and correspondingly bound sub-volumes of the interior 2 configured one above the other in a vertical direction (y direction) and thus in the heightwise direction of the domestic refrigeration appliance 1. The compartment dividers 9 to 12 therefore also represent a base for positioning foodstuffs in the form of food and beverages for the space or sub-volume configured above in each instance.

In the exemplary embodiment a plurality of pull-out boxes 13, 14 and 15 are also configured in the interior 2. These pull-out boxes 13 to 15 are also configured to accommodate foodstuffs and can be pulled out and pushed back in again in a horizontal direction and therefore in the depthwise direction (z direction) of the domestic refrigeration appliance 1.

As shown, the uppermost container in respect of height or the pull-out box 13 extends over a smaller depth than the pull-out boxes 14 and 15 arranged below. The further pull-out box 14, which is arranged directly below the topmost pull-out box 13, therefore extends further in the direction of a loading opening of the interior 2, so that a further plate 16 between the pull-out boxes 13 and 14 also forms a storage region in front of the pull-out box 13. This plate 16 is preferably made of a material that allows the passage of light in the spectral range visible to humans at least in the region that extends forward in relation to the pull-out box 13.

As also shown, front faces or end faces of the pull-out boxes 13 to 15 are also configured to allow the passage of light in the spectral range visible to humans at least in parts.

The domestic refrigeration appliance 1 also comprises a door 17, shown in the opened state in FIG. 1. The door 17 can be opaque but it can also be transparent so it is possible to look into the interior 2 and the foodstuffs therein can be identified even in the closed state. With a transparent embodiment in particular provision can preferably be made for a lighting apparatus 18 also to be active or activatable and to illuminate the interior 2 in a uniform manner.

The domestic refrigeration appliance 1 further comprises the lighting apparatus 18. This lighting apparatus 18 is formed to illuminate the interior 2. It is configured in such a manner that the interior 2 with its sub-volumes, which are bounded and formed by the compartment dividers 9 to 12, has a substantially uniform illumination, even in the regions of the pull-out boxes 13 to 15.

To this end the lighting apparatus 18 comprises a plurality of light sources. In the exemplary embodiment two first light sources 19 and 20 are arranged on the top wall 4.

These first light sources 19 and 20 are positioned in a rear quarter of the depth of the interior 2 when said interior 2 is viewed in a depthwise direction and thus in the z direction.

The lighting apparatus 18 further comprises two second light sources 21 and 22, which are also arranged on the top wall 4. The second light sources 21 and 22 are arranged in a front quarter of the depth of the interior 2 when viewed in the depth wise direction of the interior 2.

Figure 2:
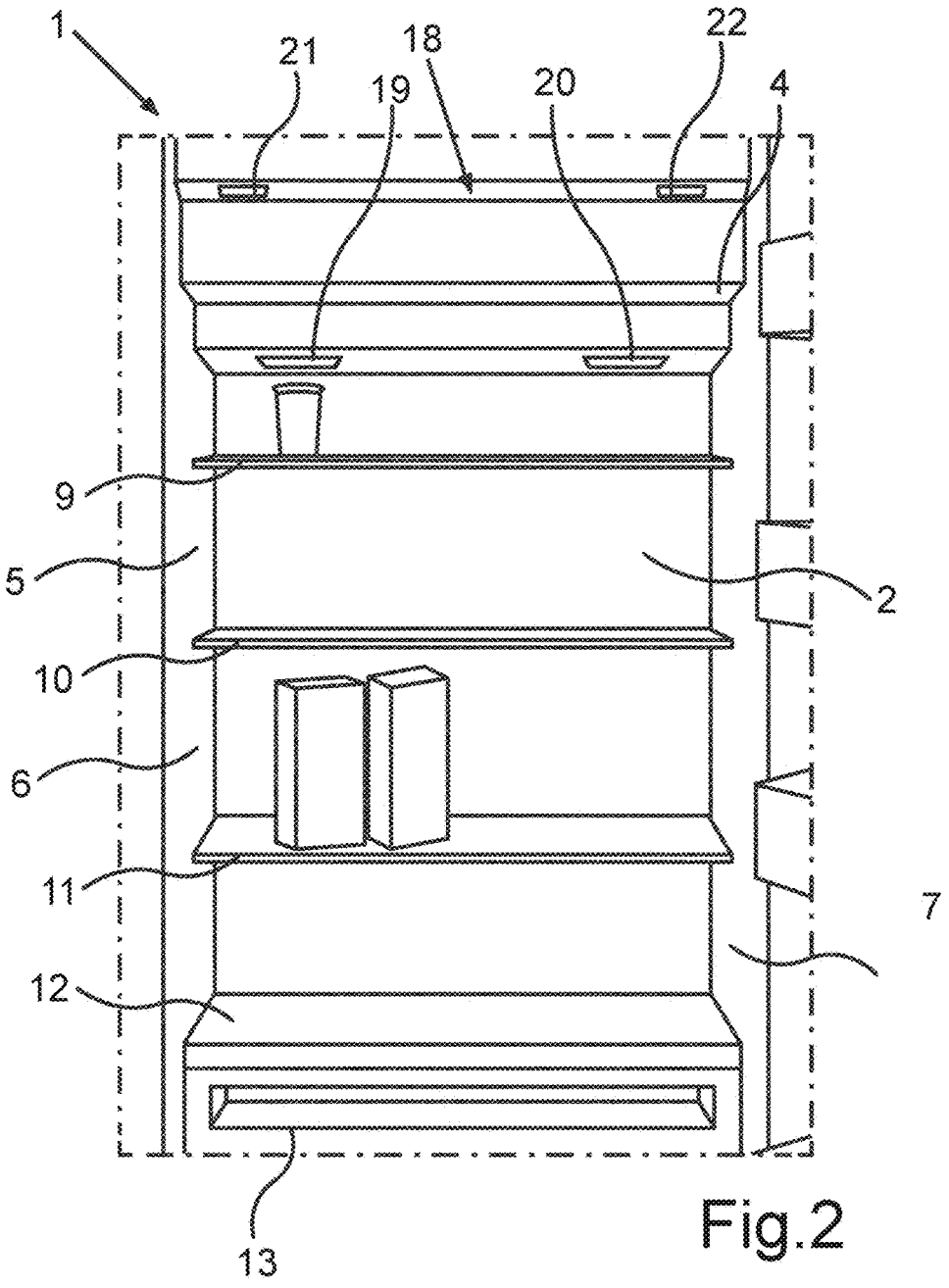
FIG. 2 shows a front view of a sub-region of the domestic refrigeration appliance shown in FIG. 1.

As shown in FIG. 2, the two second light sources 21 and 22 are positioned closer to the respective adjacent side walls 6 and 7 than the first light sources 19 and 20, which are arranged further back on the top wall 4. When viewed in the y direction and therefore perpendicular to the top wall 4 with a projection into the top plane said four light sources 19 to 22 are arranged in such a manner that connecting lines between the respectively adjacent light sources 19 to 22 bound a surface that is trapezoidal in shape in a peripheral direction, for example in the clockwise direction.

As also shown, the front second light sources 21 and 22 are arranged higher, when viewed in a vertical direction, than the rear first light sources 19 and 20.

The light sources 19 to 22 can each have at least one light-emitting diode.

Figure 3:
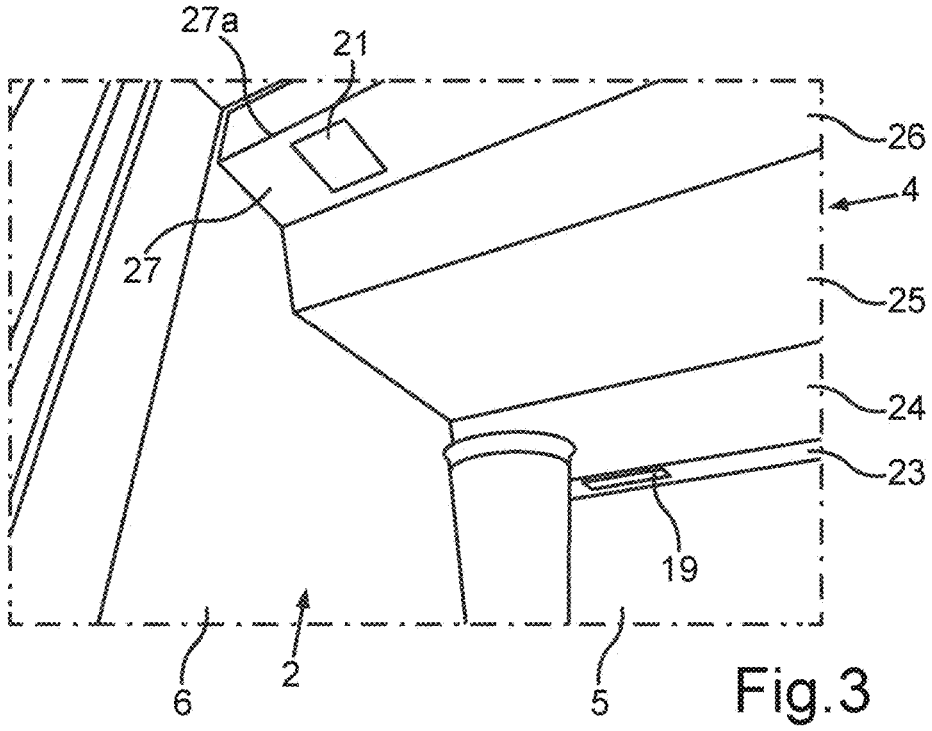
FIG. 3 shows a perspective diagram of an enlarged sub-region of the domestic refrigeration appliance as shown in FIGS. 1 and 2 with a top wall.

As shown in the diagram in FIG. 3, which shows an enlarged detail of the interior 2 in the region of the top wall 4 and the side wall 6, the top wall is not flat. In particular it is stepped or shaped as a step.

Provision is made in this respect in the exemplary embodiment for the first light sources 19 and 20 to be arranged in a rear first deepest step plateau 23. Adjoining this first step plateau 23 to the front a rising wall 24 is formed. A further step plateau 25 is formed adjoining said rising wall 24 to the front. When viewed in a depthwise direction to the front again a further rising wall 26 is configured adjoining said second step plateau 25. A third step plateau 27 is formed adjoining said rising wall 26 again to the front. The two second light sources 21 and 22 are arranged in this third step plateau 27.

The third step plateau 27 in particular is oriented at an oblique angle to a horizontal plane and therefore an x-z plane. When viewed in a depthwise direction this angled orientation is oriented down and to the rear. This should be seen as starting from a front edge 27*a*.

Figure 4:
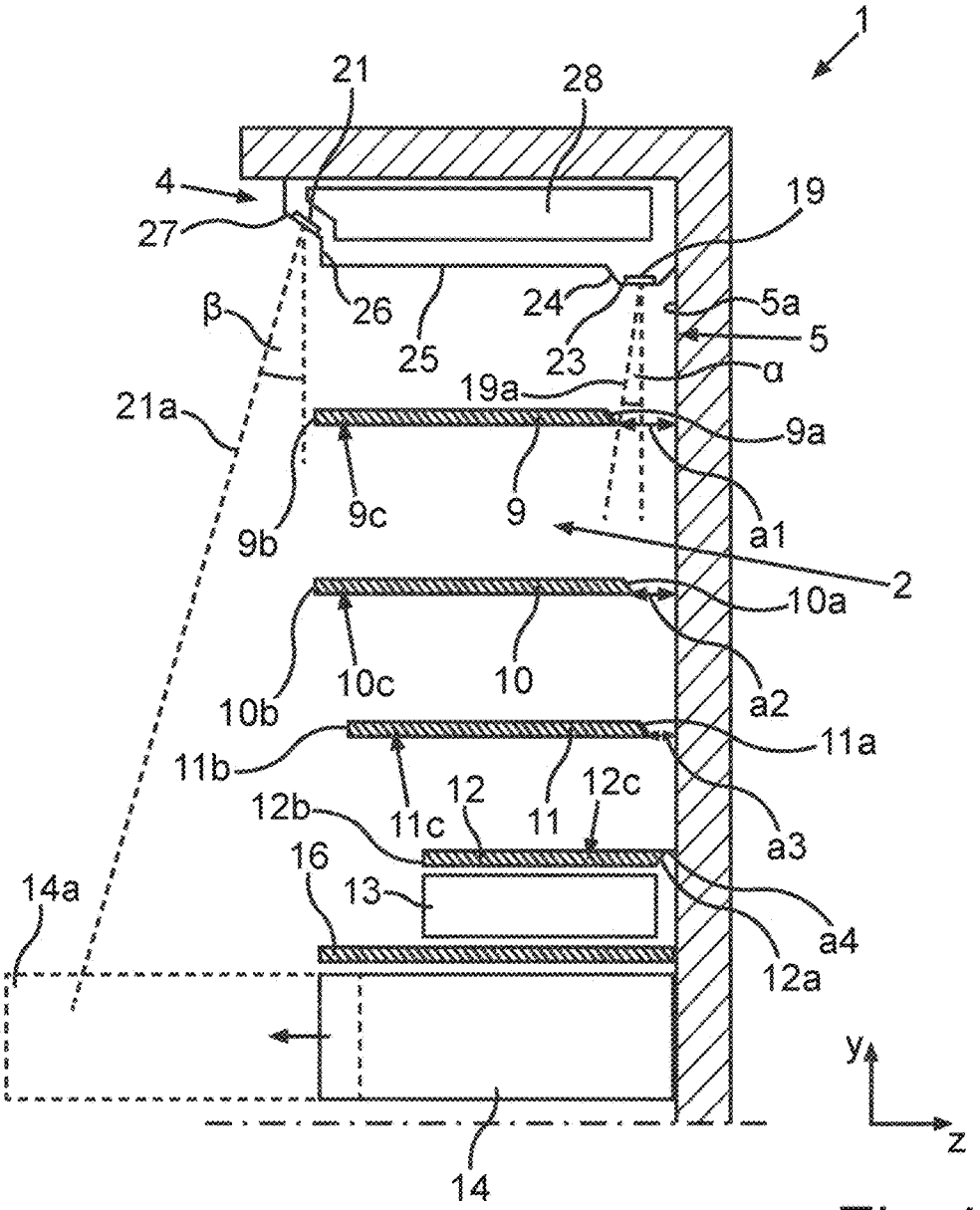
FIG. 4 shows a schematic sectional diagram of the domestic refrigeration appliance as shown in FIGS. 1 to 3.

To describe the functionality of the lighting apparatus 18 further, reference is now made to the schematic longitudinal sectional diagram (section in the y-z plane) in FIG. 4.

The stepped shape of the top wall 4 is shown. The top wall 4 conceals an evaporator 28 of a refrigeration circuit of the domestic refrigeration appliance 1. The lighting apparatus 18 with the specifically located light sources 19 to 22 is configured in such a manner that the interior 2 is illuminated in a substantially uniform manner.

The rear first light sources 19 and 20 are oriented in such a manner that the main radiation directions of their emitted light, one main radiation direction 19*a* of which is shown in FIG. 4, is arranged at an angle $\alpha$ to the vertical and therefore also facing an inner face 5*a* of the rear wall 5. An angle $\alpha$ between this main radiation direction 19*a* and the inner face 5*a* is preferably between 5° and 30°.

Provision is preferably also made for the second light sources 21, 22 also to be arranged in such a manner that main radiation directions, one main radiation direction 21*a* of which is shown in FIG. 4, are oriented at an angle $\beta$ to the vertical. This angle $\beta$ can also preferably be between 5° and 30°.

As also shown in FIG. 4, the second light sources 21 and 22 are arranged in such a manner that when viewed in a depthwise direction their dimensions extend in front of the compartment dividers 9 to 12 at least in parts.

This specific positioning and orientation mean that a desired illumination of the interior 2 in front of the compartment dividers 9 to 12 is also achieved in particular by said second light sources 21 and 22. In particular a desired uniform illumination of an inside 14*a* of the pull-out box 14 is achieved in its pulled out state (shown by the dashed line in FIG. 4). Corresponding functionality and illumination are also achieved for the container not shown in FIG. 4 or the pull-out box 15. Illumination of the interior in the pulled out state is also achieved in respect of the pull-out box 13.

As also shown in FIG. 4, the rear first light sources 19 and 20 are also arranged and oriented in such a manner that the emitted light is radiated to all the compartment dividers 9 to 12 configured as light guides.

The compartment divider 9 configured as a light guide is configured with a rear light injection region 9*a* for this purpose. This light injection region 9*a* extends over the entire width of the compartment divider 9 and is formed by a configuration of the rear edge of said compartment divider 9 which is oriented obliquely to the rear and downward. This light injection region 9*a* thus allows a desired injection of a light component of the light emitted from the light sources 19 and 20, which is then guided and output into the compartment divider 9 by total reflection to light output regions 9*b*, which are formed by the front edge of the compartment divider 9, and lateral light output regions 9*c*, which are formed by the opposing side edges of the compartment divider 9. In a similar configuration the further compartment dividers 10 to 12 comprise light injection regions 10*a*, 11*a* and 12*a*, each formed by the obliquely chamfered rear edges. As shown, the three upper compartment dividers 9 to 11 are configured with identically oriented light injection regions 9*a* to 11*a*, which are angled obliquely downward to the rear. By way of example the optional configuration where said light injection region 12*a* can be oriented obliquely forward and downward is also shown for the compartment divider 12.

These compartment dividers 10 to 12, which are configured as plate-type light guides, also have light output regions 10*b*, 11*b* and 12*b* through the front-face or front edges.

Provision is also made here in particular for the opposing side edges each to form lateral light output regions 10*c*, 11*c* and 12*c*.

As shown in the diagram in FIG. 4, said rear edges of the compartment dividers 9 to 12 and therefore also the light injection regions 9*a* to 12*a* in one exemplary embodiment are at different distances from an inner face 5*a*. To this end the upper most compartment divider 9 is arranged in such a manner that a distance a1 viewed in a depthwise direction is great than a distance a2 for the compartment divider 10 arranged directly below. A distance a3 between the light injection region 11*a* of the compartment divider 11 immediately below the compartment divider 10 is in turn shorter than the distance a2.

Provision is also made for a distance a4 in turn to be shorter than the distance a3. This means that as the height of the compartment dividers 9 to 12 decreases, the distance between a rear edge and therefore a light injection region 9*a* to 12*a* of a compartment divider 9 to 12 and the inner face 5*a* decreases. Such a configuration allows the light emitted downward by the first light sources 19 and 20 from the top wall 4 to be distributed to each of the compartment dividers 9 to 12 in the desired proportion, allowing uniform light injection and therefore also correspondingly uniform light output. This also advantageously contributes to the overall uniform illumination of the interior 2.

Provision can also be made in particular for a rear edge of the plate 16, which is also configured for light guidance, to be arranged at a further distance from the inner face 5*a*. Provision can be made for this distance to be shorter than the distance a4.

In a further embodiment provision can preferably be made for the distances a1 to a4 to be identical. In particular the distance between the rear edge of the plate 16 and the inner face 5*a* can then be shorter than or equal to the other distances a1 to a4.

In a further embodiment provision can be made for the distances a1 to a3 to be identical. This therefore relates to all the compartment dividers 9 to 11, below which a space or sub-volume of the interior 2 with unlimited access at the front face is configured. With this embodiment provision is also preferably made for the distance a4 then to be shorter than the identical distances a1 to a3. In particular the distance a4 to the compartment divider 12, below which a pull-out box 13 is directly arranged and with which the compartment divider 12 virtually forms a lid for said pull-out box 13, is therefore shorter.

Provision can also be made for at least one compartment divider 9 to 12 to be able to be pulled out horizontally and therefore to be configured in the manner of a pull-out box for presenting the foodstuffs stored thereon in parts in front of the interior. With such an embodiment in particular the orientation of the light sources 21 and 22 is advantageous, as it allows illumination from above in front of the interior and therefore the pulled out sub-region of the compartment divider. This is preferred for compartment dividers positioned lower down, for example the compartment dividers 10 or 11. It is particularly preferred for the compartment divider 11 and/or 12, which are anyway horizontally shorter than the compartment dividers arranged above and can therefore be illuminated from above when they are pulled out at least partially and in front of the front edge of the compartment dividers arranged above, in particular the compartment dividers 9 and 10.

The arrangement and orientation of the first light sources 19 and 20 means that the illumination in the rear region and radiation to the individual light injection regions 9*a* to 12*a* are not undesirably impaired even when there is a large quantity of foodstuffs in the interior 2. The orientation of the light sources 19 and 20 with their main radiation directions 19*a* angled obliquely forward also prevents too much light on the inner face 5*a*, causing undesirably significant local reflection and brightness regions to form.

With the configuration of the light injection region 9*a* provision is made in FIG. 4 for it to be configured by a surface of a part of the rear narrow edge of the compartment divider 9, which connects an upper face and a lower face of the compartment divider 9, or preferably the surface of the entire edge at an angle other than 90° to an upper face and a lower face of the compartment divider 9. Such an angling of said rear edge produces a particularly advantageous light injection region 9*a*, which allows extensive light injection, so a particularly large quantity of light passes into the compartment divider 9 and can be radiated out again at the light output region 9*b*, 9*c*, thereby achieving improved illumination by the lighting apparatus 18 here too.

Precisely such angling of the rear edge causes optical surfaces to be formed, which allow improved injection and also, depending on orientation, a high reflection coefficient of light already injected into the compartment divider 9 in the desired direction to the light output region 9*b*, 9*c*. This angled orientation of the rear edge can thus be oriented both obliquely downward and to the rear from the upper face as well as in the counter direction and therefore obliquely downward and forward from the upper face, as is the case with compartment divider 12.

Said surface of said part of the rear edge or the surface of the entire edge, which is configured at an angle other than 90° to an upper face of the compartment divider 9, is preferably configured as a flat surface. Thus in a longitudinal section or vertical section through the compartment divider 9 shown in FIG. 4 said compartment divider 9 is configured as wedge-shaped or as pointed or tapering to the rear in the rear region. In this sectional view therefore two straight lines, those of the lower face and the flat surface of the rear edge, meet at an angle smaller than 90°. With this embodiment as a flat surface maximizing light injection appropriate for each situation is achieved as a function of the angle. Details relating to the compartment divider 9 also apply to the compartment dividers 10 and 11 and inversely for the compartment divider 12 with regard to the orientation of the light injection region 12*a*.

Figure 5:
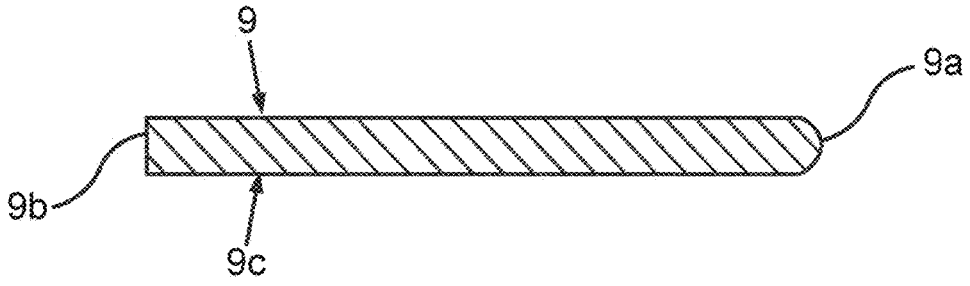
FIG. 5 shows a schematic sectional diagram of an exemplary embodiment of a light injection region of a compartment divider.

Provision is particularly preferably made for said surface of said part of the rear edge or the surface of the entire edge, which is configured at an angle other than 90° to an upper face of the compartment divider 9, to be configured as a curved surface, as shown in the exemplary longitudinal sectional diagram in FIG. 5. Said surface is preferably curved in a convex manner at least in parts, in particular being curved in a convex manner, in particular being curved in a uniformly convex manner, over its entire extension between an upper face and a lower face of the compartment divider 9. As a result in a longitudinal section or vertical section through the compartment divider 9, said compartment divider 9 is configured with a bulge, in particular a C-shaped bulge, in the rear region in the depthwise direction of the domestic refrigeration appliance 1 and therefore in the z direction. This embodiment is particularly advantageous in that it is simple to configure and produce and in that it minimizes reflection and maximizes light component injection. Uniform illumination of the interior 2 is thus achieved to a particular degree. Details relating to the alternative embodiment of the compartment divider 9 also apply to the compartment dividers 10 to 12.

| List of reference characters | |
|---|---|
| 1 | Domestic refrigeration appliance |
| 2 | Interior |
| 3 | Inner container |
| 4 | Top wall |
| 5 | Rear wall |
| 5a | Inner face |
| 6 | Side wall |
| 7 | Side wall |
| 8 | Base |
| 9 | Compartment divider |
| 9a | Light injection region |
| 9b | Light output regions |
| 9c | Lateral light output regions |
| 10 | Compartment divider |
| 10a | Light injection region |
| 10b | Light output region |
| 10c | Lateral light output regions |
| 11 | Compartment divider |
| 11a | Light injection region |
| 11b | Light output region |
| 11c | Lateral light output regions |
| 12 | Compartment divider |
| 12a | Light injection region |
| 12b | Light output region |
| 12c | Lateral light output regions |
| 13 | Pull-out box |
| 14 | Pull-out box |
| 14a | Inside |
| 15 | Pull-out box |
| 16 | Plate |
| 17 | Door |
| 18 | Lighting apparatus |
| 19 | First light source |
| 19a | Main radiation direction |
| 20 | First light source |
| 21 | Second light source |
| 21a | Main radiation direction |
| 22 | Second light source |
| 23 | Step plateau |
| 24 | Rising wall |
| 25 | Step plateau |
| 26 | Rising wall |
| 27 | Step plateau |
| 27a | Front edge |
| 28 | Evaporator |
| a1 | Distance |
| a2 | Distance |
| a3 | Distance |
| a4 | Distance |
| α | Angle |
| β | Angle |

The invention claimed is:

1. A domestic refrigeration appliance, comprising:

an interior for accommodating foodstuffs;

walls including a top wall bounding said interior;

a door for closing said interior;

at least one plate-shaped compartment divider disposed in said interior and formed of a light-permeable material, said at least one compartment divider including a rear region having a light injection region configured as a light guide, and said at least one compartment divider including a light output region;

a lighting apparatus configured to illuminate said interior at least while said door is open, said lighting apparatus having a plurality of light sources disposed in said top wall, emitting light and being oriented to substantially uniformly illuminate said interior above and below said at least one compartment divider due to the emitted light from said light sources; and said plurality of light sources including first light sources emitting light striking said light injection region and being guided to said light output region of said at least one compartment divider.

2. The domestic refrigeration appliance according to claim 1, wherein said at least one compartment divider has an upper face, a lower face and a rear edge, and said light injection region is formed by at least part of said rear edge having a surface enclosing an angle other than 90° with at least one of said upper or lower faces.

3. The domestic refrigeration appliance according to claim 2, wherein said surface of at least part of said rear edge enclosing an angle other than 90° with at least one of said upper or lower faces, is a flat surface.

4. The domestic refrigeration appliance according to claim 2, wherein said surface of at least part of said rear edge enclosing an angle other than 90° with at least one of said upper or lower faces, has a curved, convex or C-shaped surface in a longitudinal section.

5. The domestic refrigeration appliance according to claim 1, wherein said walls bounding said interior include a rear wall having an inner face, and said light injection region is disposed at a distance from said inner face.

6. The domestic refrigeration appliance according to claim 1, wherein said at least one compartment divider has a front edge and a side edge, and said light output region is formed by at least one of said front edge or said side edge.

7. The domestic refrigeration appliance according to claim 1, wherein said walls bounding said interior include a vertical rear wall, and said first light sources have main radiation directions oriented obliquely forward relative to said vertical rear wall.

8. The domestic refrigeration appliance according to claim 7, wherein said main radiation directions are oriented obliquely forward at an angle of between 5° and 30° relative to said vertical rear wall.

9. The domestic refrigeration appliance according to claim 1, wherein:

said walls bounding said interior include a rear wall having an inner face;

said at least one compartment divider includes at least two compartment dividers formed at least in part of a light-permeable material, said at least two compartment dividers include a higher and a lower compartment divider;

said at least two compartment dividers are disposed at different heights in said interior and are each configured at least partially with a rear edge having a light injection region; and said rear edge of said higher compartment divider is disposed at a first distance from said inner face of said rear wall and said rear edge of said lower compartment divider is disposed at a second distance from said inner face of said rear wall being is shorter than said first distance.

10. The domestic refrigeration appliance according to claim 1, wherein said top wall has a depth, and said first light sources are disposed in a rear quarter of said depth of said top wall.

11. The domestic refrigeration appliance according to claim 1, wherein said top wall has a depth, and said lighting apparatus has at least two second light sources disposed in a front quarter of said depth of said top wall.

12. The domestic refrigeration appliance according to claim 1, wherein said top wall has a depth, said first light sources are disposed in a rear quarter of said depth of said top wall, and said lighting apparatus has at least two second light sources disposed in a front quarter of said depth of said top wall.

13. The domestic refrigeration appliance according to claim 11, wherein:

said walls bounding said interior include a vertical rear wall;

said interior has a depth-wise direction;

said at least one compartment divider has a front edge;

said second light sources at least in part extend forward over said front edge of said at least one compartment divider in said depth-wise direction; and said second light sources have main radiation directions oriented obliquely forward relative to said vertical rear wall.

14. The domestic refrigeration appliance according to claim 11, wherein said interior has a depth-wise direction, said at least one compartment divider has a front edge, and said second light sources at least in part extend forward over said front edge of said at least one compartment divider in said depth-wise direction.

15. The domestic refrigeration appliance according to claim 11, wherein said walls bounding said interior include a vertical rear wall, and said second light sources have main radiation directions oriented obliquely forward relative to said vertical rear wall.

16. The domestic refrigeration appliance according to claim 15, wherein said main radiation directions are oriented obliquely forward at an angle of between 5° and 30° relative to said vertical rear wall.

17. The domestic refrigeration appliance according to claim 11, which further comprises at least one pull-out box having an inside and being disposed below said at least one compartment divider, said second light sources having main radiation directions oriented into said inside of said at least one pull-out box when said at least one pull-out box is fully open.

18. The domestic refrigeration appliance according to claim 11, wherein said interior has a depth-wise direction, said top wall has at least two downward steps in said depth-wise direction forming a rear first step plateau and a front further step plateau, said first light sources are disposed in said rear first step plateau and said second light sources are disposed in said front further step plateau being is higher than said first step plateau.

19. The domestic refrigeration appliance according to claim 1, wherein said top wall defines a top wall plane, said lighting apparatus has at least two of said first light sources and at least two second light sources disposed on said top wall, and imaginary lines connecting each two respective adjacent light sources in a peripheral direction form a trapezoidal shape in said top wall plane.

20. The domestic refrigeration appliance according to claim 1, wherein said walls bounding said interior include a rear wall, said trapezoidal shape has a shorter base side and a longer base side, and said shorter base side is closer to said rear wall than said longer base side.

21. The domestic refrigeration appliance according to claim 1, wherein said walls bounding said interior include said top wall, a rear wall and side walls having inner faces facing said interior, and at least some of said walls are made of a metallic material or stainless steel at least on said inner faces facing said interior.

* * * * *